US006133680A

United States Patent [19]

Lo

[11] Patent Number: 6,133,680

[45] Date of Patent: Oct. 17, 2000

[54] DISCHARGE ELECTRODE STRUCTURE

[76] Inventor: Ching-Hsiang Lo, No. 104, Huah-Cherng Rd., Shin-Juang City, Taipei Hsien, Taiwan

[21] Appl. No.: 09/229,574

[22] Filed: Jan. 13, 1999

[51] Int. Cl.[7] ..... H01J 1/02

[52] U.S. Cl. ..... 313/351; 313/309

[58] Field of Search ..... 313/351, 309, 313/336; 445/35, 49, 50, 51; 55/152

[56] References Cited

U.S. PATENT DOCUMENTS

| | | | |
|---|---|---|---|
| 2,195,431 | 4/1940 | Shively et al. | 313/351 |
| 4,303,418 | 12/1981 | Coe, Jr. | 55/145 |
| 4,375,364 | 3/1983 | Van Hoeson et al. | 55/152 |

*Primary Examiner*—Michael H. Day
*Assistant Examiner*—Todd Reed Hopper
*Attorney, Agent, or Firm*—Dougherty & Troxell

[57] ABSTRACT

A discharge electrode structure which is a substantially II-shaped sheet unit integrally made from one single blank sheet. The discharge electrode sheet unit includes two conductive sections connected with each other by two bridge sections at two ends. Two sides of each bridge section are formed with screw holes. Each conductive section is formed with a middle transverse bar formed with multiple perpendicular discharge needles at equal intervals. Each discharge needle has a tip. After the discharge electrode is connected with a DC high voltage power supply, free electrons are produced by discharging. The tips of the discharge needles are perpendicularly arranged at equal intervals so that ionic equilibrium can be easily achieved.

3 Claims, 8 Drawing Sheets

DISCHARGE ELECTRODE STRUCTURE

BACKGROUND OF THE INVENTION

The present invention relates to a discharge electrode structure, and more particularly to a discharge electrode including integrally formed discharge needles for easily achieving ionic equilibrium. The discharge electrode is applicable to a static-eliminating device.

FIGS. 1*a*, 1*b* and 2 show a commercially available discharge electrode applicable to static-eliminating device. In FIG. 1*a*, the discharge electrode includes a conductive rod 30 implanted with discharge needles 31 at equal intervals. In order to achieve optimal discharge efficiency, the distances between the respective discharge needles are strictly controlled to be equal to each other. In addition, the heights of the discharge needles projecting from the conductive rod 30 are also strictly controlled to be equal to each other. The tail ends of the discharge needles 31 are ground planely. One end of the conductive rod 30 is added with a positive electrode 33 and the upper side of the tips of the discharge needles 31 are connected with an electrode panel 32 with negative electrode 34 (as shown in FIG. 1*b*). Accordingly, the discharge needles will discharge from the tips and create a great amount of free electrons and ions to eliminate the static electricity.

FIG. 2 shows an existing tip discharge electrode including an elongated electrode shaft 40 formed with thread holes 41 at equal intervals. A discharge needle 42 is screwed into each thread hole 41. One end of the discharge needle 42 is formed with outer thread 43. A root section of the thread 43 is milled with a stopper nut 44 with a certain thickness. The other end of the discharge needle 42 is milled into a sharp conic section 45. Such discharge needle is able to achieve better electric field and discharging effect. However, the manufacturing procedure is quite complicated.

It is known from the above that the conventional discharge electrode is manufactured by a quite complicated procedure under strict control of accuracy. Therefore, the production efficiency can be hardly promoted.

SUMMARY OF THE INVENTION

It is a primary object of the present invention to provide a discharge electrode structure which is integrally formed and able to easily achieve ionic equilibrium.

It is a further object of the present invention to provide the above discharge electrode structure which is easily manufactured and able to achieve excellent discharging effect.

According to the above objects, the discharge electrode structure of the present invention is a substantially II-shaped sheet unit integrally made from one single metal sheet. The discharge electrode sheet unit includes two conductive sections connected with each other by two bridge sections at two ends. Two sides of each bridge section are formed with screw holes. Each conductive section is formed with a middle transverse bar formed with multiple perpendicular discharge needles at equal intervals. Each discharge needle has a tip. Free electrons are produced by discharging effect of the discharge electrode. The tips of the discharge needles are perpendicularly arranged at equal intervals so that ionic equilibrium can be easily achieved.

The present invention can be best understood through the following description and accompanying drawings, wherein:

DETAILED DESCRIPTION OF THE PREFERRED EMBODIMENT

Figure 1A:
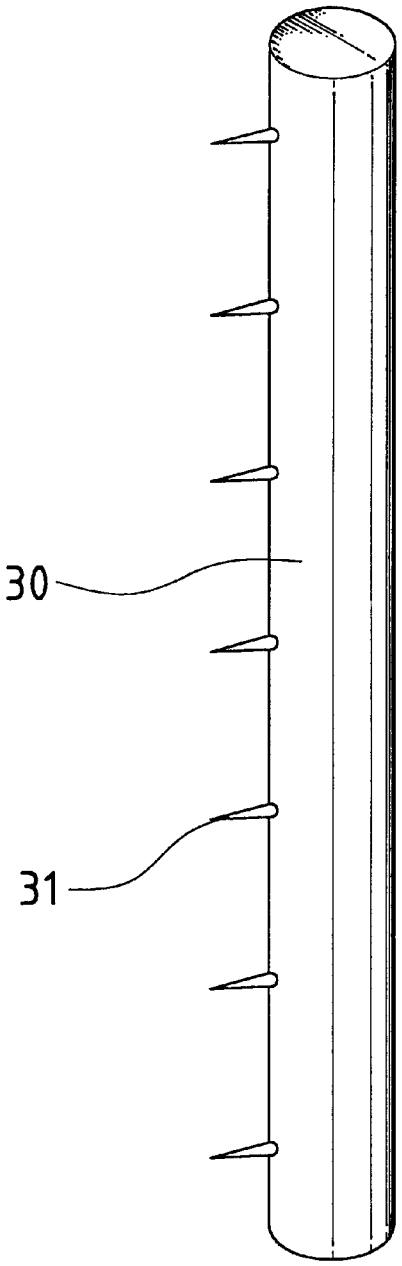
FIG.1A PRIOR ART
FIG. 1*a* is a perspective view of a conventional discharge electrode.
Figure 1B:
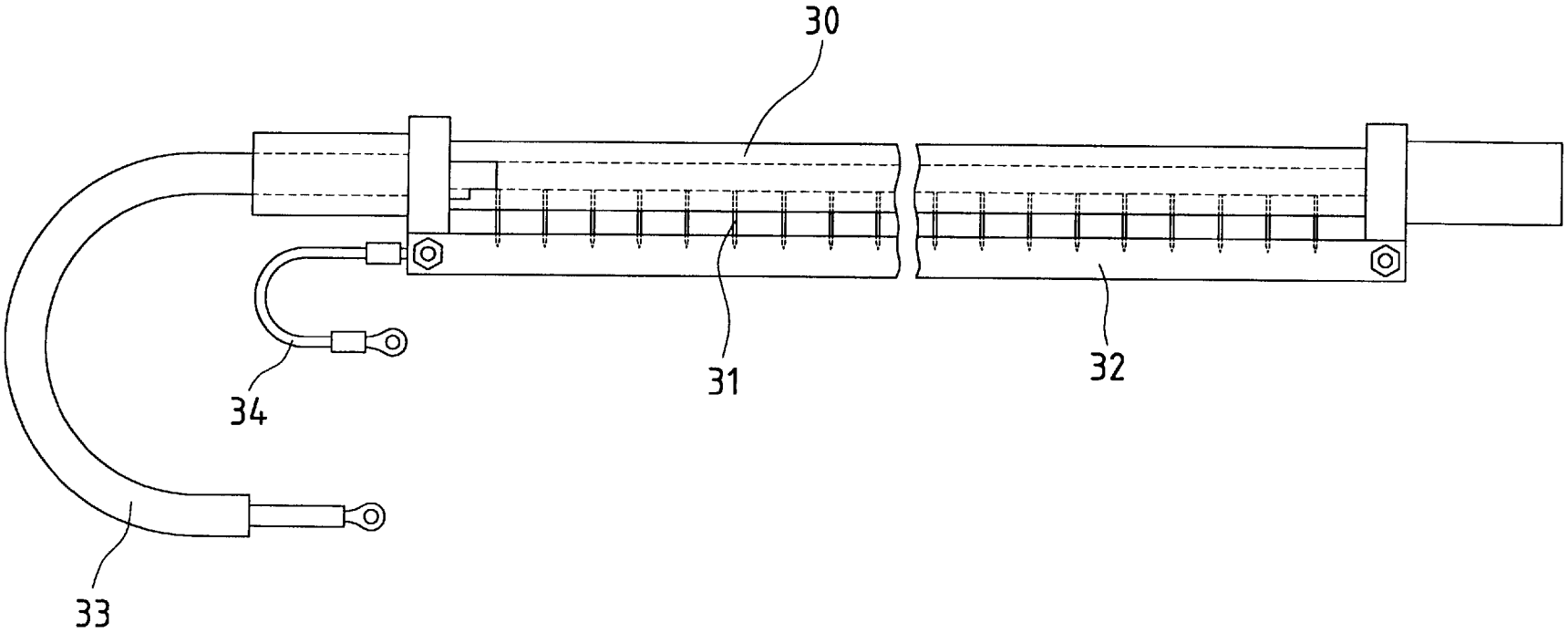
FIG.1B PRIOR ART
FIG. 1*b* is a plane view of a conventional static-eliminating device.
Figure 2:
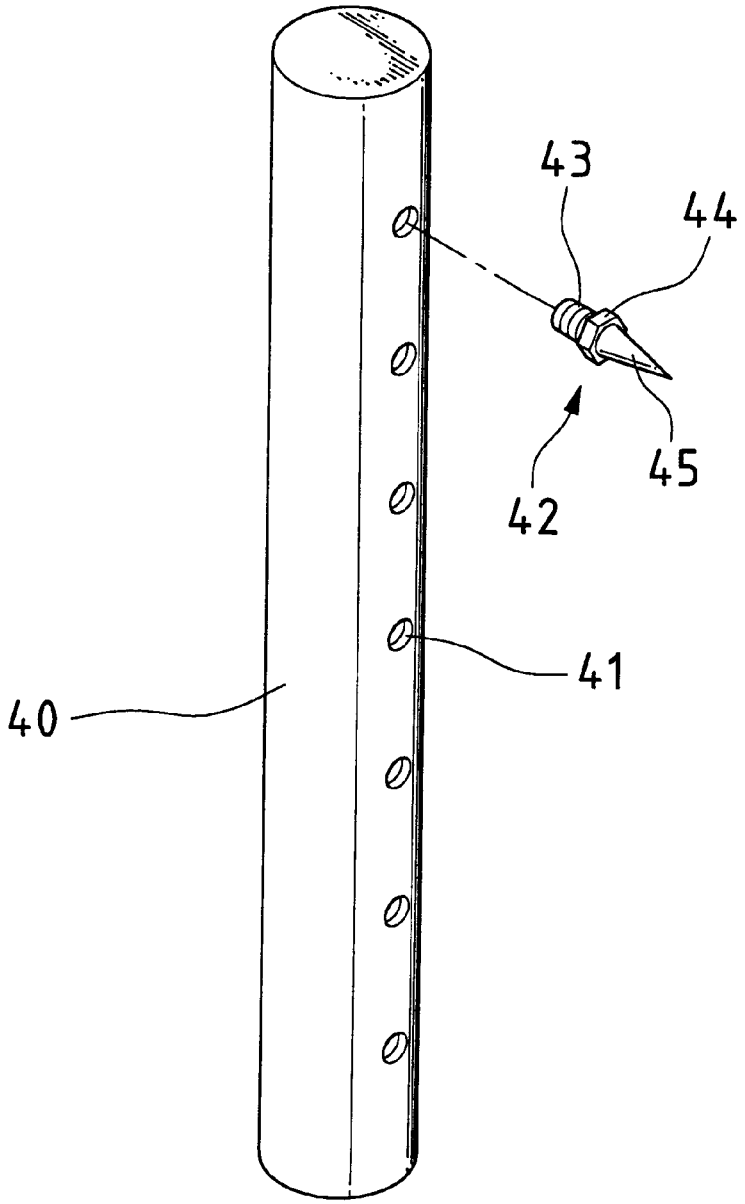
FIG.2 PRIOR ART
FIG. 2 is a perspective exploded view of another conventional tip discharge electrode.
Figure 3:
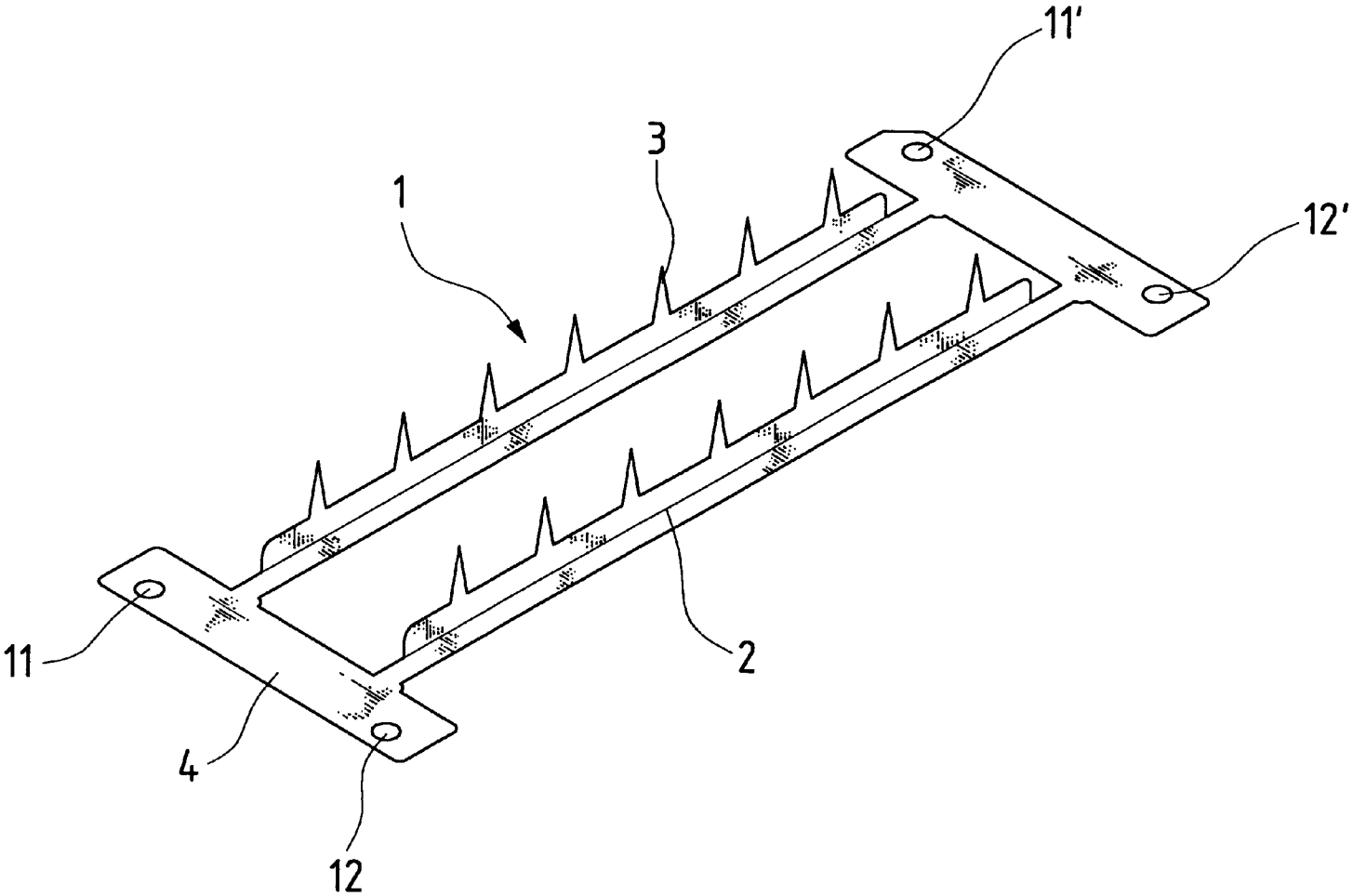
FIG. 3 is a perspective view of the present invention.

Please refer to FIG. 3. The present invention is a substantially II-shaped sheet body 1 integrally made from one single blank sheet. The discharge electrode sheet body includes conductive sections 2, discharge needles 3 and bridge sections 4. The bridge sections are integrally connected with the conductive sections. Two sides of each bridge section are formed with screw holes 11, 11', 12, 12'. The conductive section 2 is formed with a middle transverse bar formed with multiple perpendicular discharge needles 3 at equal intervals.

Figure 4:
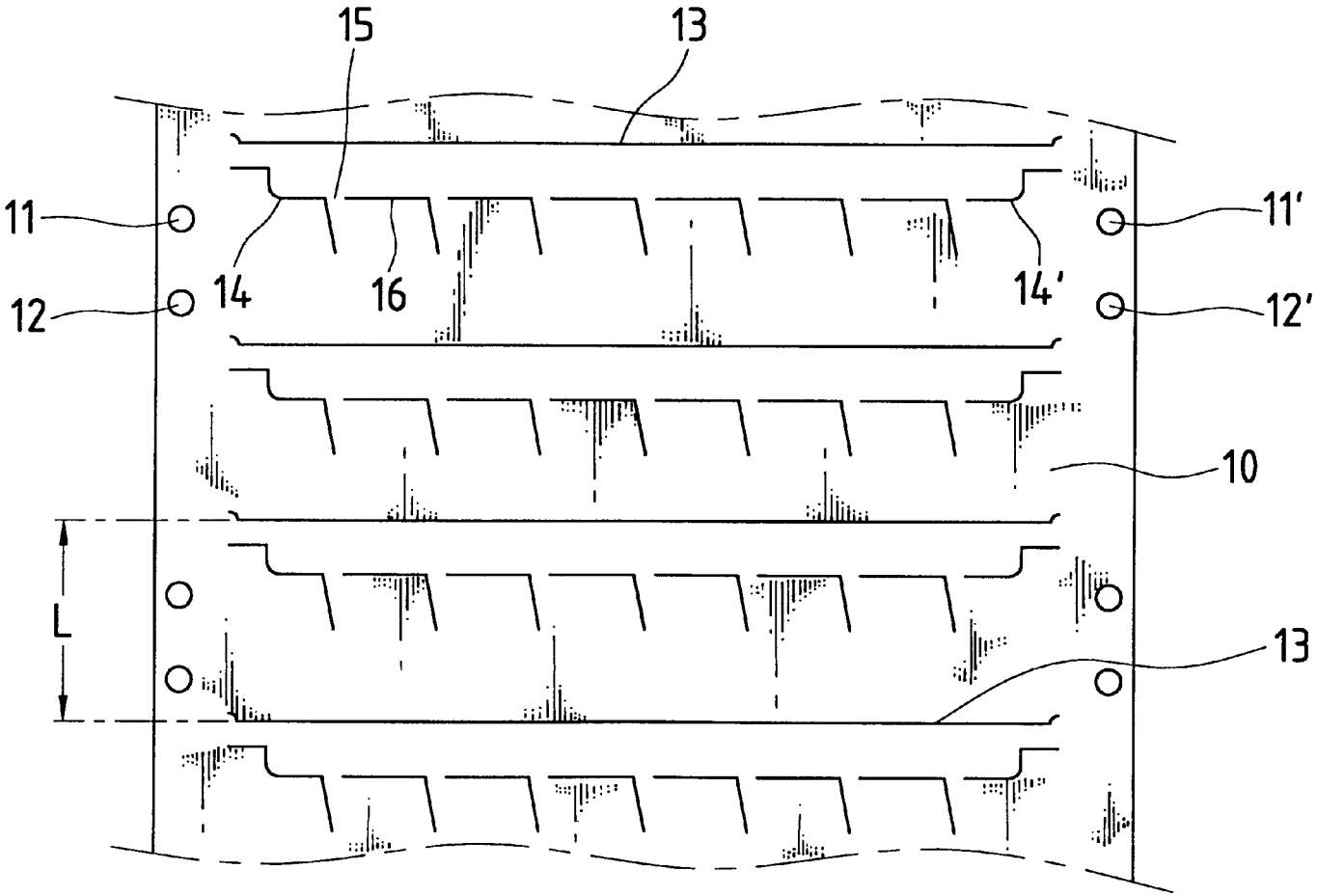
FIG. 4 shows a first step of the punching operation of the present invention.

Referring to FIG. 4, the present invention is made of one single metal sheet 10. Two ends of the sheet body 10 are punched with multiple adjacent screw holes 11, 11', 12, 12'. The metal sheet 10 is sequentially punched with multiple long cut lines 13 at equal intervals. Each end of the long cut line 13 is formed with a short arch line. The other side of the long cut line 13 is punched with edge cut lines 14, 14' and obtuse cut lines 16 each having a turning section. The end of each obtuse cut line 16 is reserved with a small reservation section 15 not cut off Under the condition that the first row of long cut lines 13 is reserved with a fixed distance, the metal sheet 1 is respectively punched with second, third, fourth, nth rows of long cut lines 13. Similarly, the edge cut lines 14, 14' and the obtuse cut lines 16 are disposed on opposite side along with the long cut lines 13.

Figure 5:
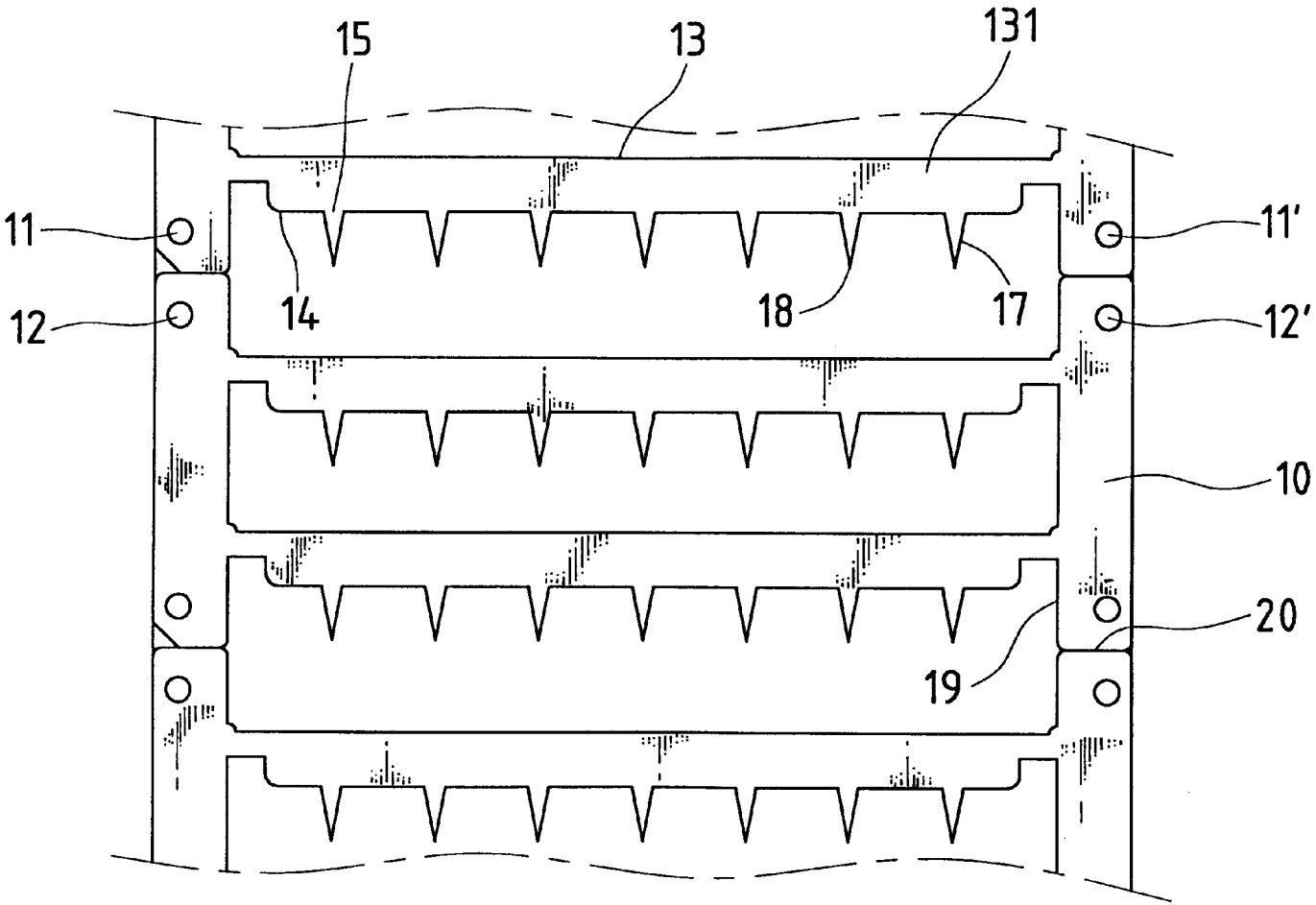
FIG. 5 shows a second step of the punching operation of the present invention.
Figure 6:
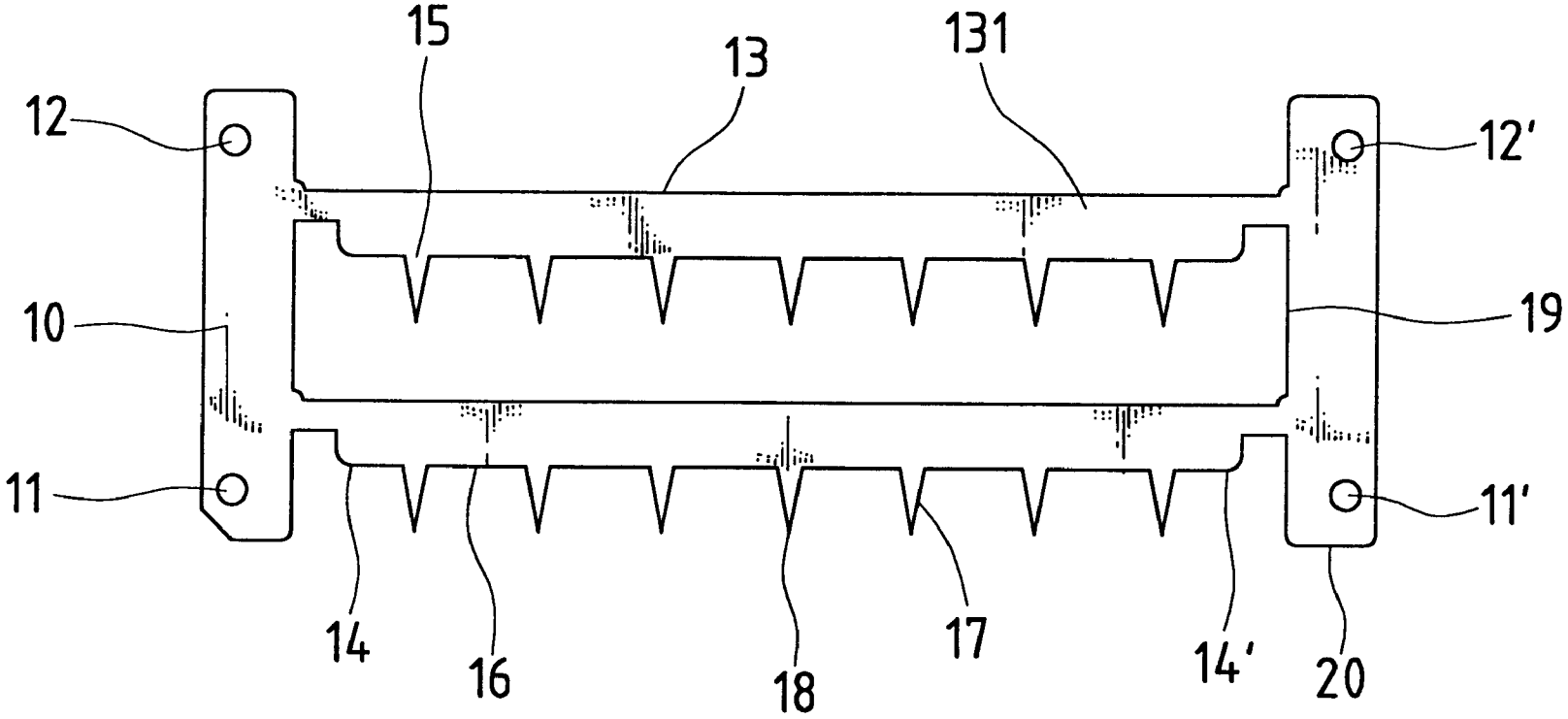
FIG. 6 shows a third step of the punching operation of the present invention.

Referring to FIG. 5, furthermore, another inclined cut line 17 reversely inclined to the obtuse cut line 16 is punched between the tail end of the horizontal line of the obtuse cut line 16 and the head end of the inclined line. The obtuse cut line 16 and the inclined cut line 17 together define a tip 18 of the discharge needle 3. A lateral side of each edge cut line 14 is downward punched with a perpendicular cut line 19 and thin breakage line 20 between two screw holes 11, 12 (11', 12'). A user can fold the metal sheet and break apart the metal sheet at the thin breakage line 20 so as to achieve the II-shaped discharge electrode (as shown in FIG. 6).

Figure 7:
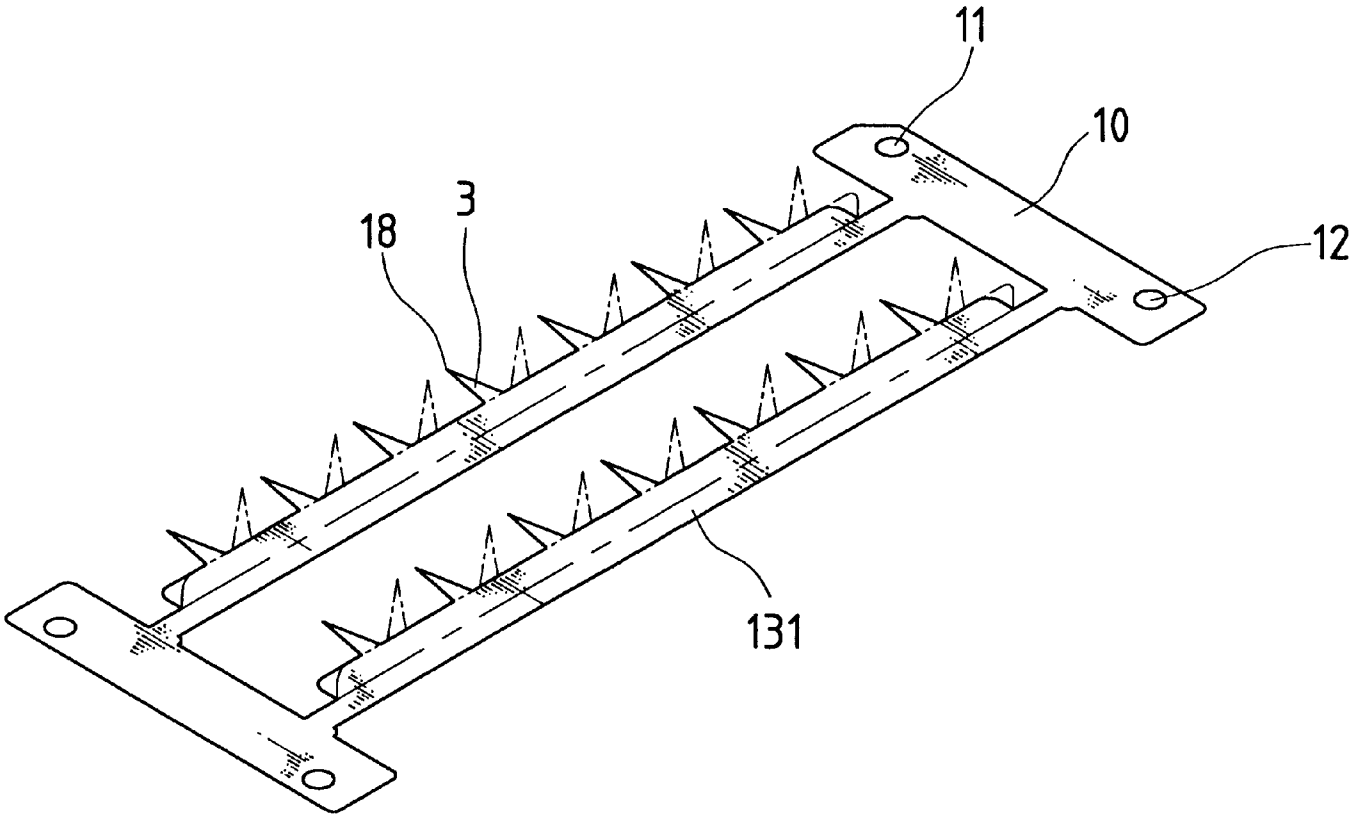
FIG. 7 shows a fourth step of the punching operation of the present invention.

Please refer to FIG. 7. After the above processing procedure is completed, finally by means of a punching and folding operation, the transverse sheet 131 with the discharge needles 3 is upward folded at one half position of the sheet body into an upright state, whereby the discharge needle 3 is perpendicular to the transverse sheet 131 of the sheet body 10.

The tip 18 of the discharge needle is formed by two cut lines so that the tip is very sharp. The above manufacturing procedure of the present invention is simpler than that of the conventional discharge electrode and the quality of the product is enhanced.

It should be noted that the above description and accompanying drawings are only used to illustrate one embodiment of the present invention, not intended to limit the scope thereof. Any modification of the embodiment should fall within the scope of the present invention.

What is claimed is:

1. A discharge electrode structure which is a substantially II-shaped sheet unit integrally made from one single blank sheet, the discharge electrode sheet unit comprising conductive sections, discharge needles and bridge sections, the bridge sections at two ends of the sheet unit being integrally connected with the conductive sections, two sides of each bridge section being formed with screw holes, each conductive section being formed with a middle transverse bar formed with multiple perpendicular discharge needles at equal intervals, each discharge needle having a tip.

2. A discharge electrode structure as claimed in claim 1, wherein a connection section between two adjacent discharge electrode units is formed with a thin breakage line.

3. A discharge electrode structure as claimed in claim 1, wherein the tip of the discharge needle is formed by two cutting procedures.

* * * * *